US005322390A

United States Patent [19]

Niimura

[11] Patent Number: 5,322,390

[45] Date of Patent: Jun. 21, 1994

[54] UNDERWATER TUNNEL AND AN UNDERWATER MOORING APPARATUS TO MOOR THE UNDERWATER TUNNEL

[76] Inventor: Masateru Niimura, 6-6-4, Ohmori Nishi, Ohta-ku, Tokyo, Japan

[21] Appl. No.: 5,103

[22] Filed: Jan. 15, 1993

[30] Foreign Application Priority Data

Jan. 17, 1992 [JP] Japan ..... 4-010045[U]
Jan. 17, 1992 [JP] Japan ..... 4-044347
Feb. 20, 1992 [JP] Japan ..... 4-082609

[51] Int. Cl.[5] ..... E21D 9/00
[52] U.S. Cl. ..... 405/136; 405/134
[58] Field of Search ..... 405/135, 136, 137, 132, 405/158, 172, 194, 134

[56] References Cited

U.S. PATENT DOCUMENTS 3,478,521 11/1969 Petrik ..... 405/136 X
3,738,112 6/1973 Grant et al. ..... 405/136
4,657,435 4/1987 Chang ..... 405/136
5,049,004 9/1991 Niimura ..... 405/204

FOREIGN PATENT DOCUMENTS 0357983 11/1905 France ..... 405/136

*Primary Examiner*—Dennis L. Taylor
*Attorney, Agent, or Firm*—Armstrong, Westerman, Hattori, McLeland & Naughton

[57] ABSTRACT

An underwater tunnel consisting of: a foundation body moored to the bottom of the water; a support frame erected on the foundation body; and a tunnel body formed integral with the support frame; wherein the tunnel body is formed in a two-layer construction which consists of an outer shell and an inner shell so that spaces formed inside the inner shell and between the outer and inner shells can be used for desired purposes, and the support frame is so formed that its vertical cross section is virtually a regular triangle and that a water tank is formed at the inside bottom of the support frame. An underwater mooring apparatus, which holds the underwater tunnel in place in the water, consists of a tension cable device whose one end is secured to an anchor and the other end is attached with a rotatable pulley, and a plurality of connecting wire devices wound around the pulley attached to the tension cable device, both ends of the connecting wire means being fixed to the structure to be moored; wherein one of the connecting wire devices is normally under tension connecting the structure to be moored and the tension cable device and the remaining connecting wire device are normally set in a loosened state so that when the first tensed connecting wire means is broken, the remaining loosened connecting wire device can take over to hold the structure in place.

5 Claims, 7 Drawing Sheets

UNDERWATER TUNNEL AND AN UNDERWATER MOORING APPARATUS TO MOOR THE UNDERWATER TUNNEL

1. FIELD OF THE INVENTION

The present invention relates to a large-scale underwater tunnel installed at the bottom of the water or in the water and also to an underwater mooring apparatus for mooring the underwater tunnel.

2. DESCRIPTION OF THE RELATED ART

In building an underwater tunnel running under the sea floor, a known conventional method involves driving sheetings or flashboards into the sea floor or erecting a wall of stones and soil to demarcate an area of water where the underwater structure is to be built, discharging water from the demarcated area, and then constructing the underwater tunnel in the same way as an ordinary building is constructed on land. Another known method is to excavate a tunnel under the seabed by using an excavating machine.

The former of the above-mentioned conventional methods ash the advantage of not being restricted by the size of the underwater tunnel and of being able to construct an underwater tunnel of a desired size without being affected by water. On the other hand, when an area of water is demarcated and the water in the area is discharged to establish the same condition as on land, the use of this method is limited only to shallow waters. Further, this method takes a long period of time, increasing the construction cost. As to the second method, an ultra-large excavator must be transported to the construction site and a tunnel built as the excavation proceeds, making the water drainage or evacuation a very complicated work, resulting in an extended work period and thereby an increased cost. The conventional methods have these drawbacks.

In mooring large-scale structures such as underwater tunnels in the sea floor or in the water, it is a common practice to connect one end of wire ropes to anchors and the other end to the structures that are to be moored.

With the conventional mooring method using wire ropes, however, when a part of the structure is projected above the water surface to provide an entry or exit for humans and supplies or when the structure must be kept at a certain draft for some structural reasons, it is not possible to quickly cope with changes in water level that are caused by environmental changes.

One possible means of solving such a problem may involve connecting the second end of the wire rope to the wire rope wind-up/feed-out equipment installed in the structure to be moored, and winding up or feeding out the wire rope according to the water level in order to make a part of the structure project above the water or keep its draft at a certain level.

However, when the wire rope is pulled into the structure, water may get into the interior of the structure. This requires a very complex water-proofing technique, making the maintenance complex and costly.

SUMMARY OF THE INVENTION

This invention has been accomplished with a view to overcoming the above-mentioned drawbacks and its objective is to provide a novel underwater tunnel, which can be used for multiple purposes and which can be built in a short period of time with a significantly reduced cost and in the same procedure as employed in constructing buildings on land by using a new construction method that is totally different from the conventional method requiring a foundation work.

It is an object of this invention to provide an underwater mooring apparatus, which eliminates the possibility of the water entering into the underwater tunnel if one end of the wire rope, with the other end connected to the anchor, is connected to the wire wind-up/feed-out equipment installed in the underwater tunnel to be moored. It is also an object of the invention to provide an underwater mooring apparatus which, if the wire rope should be broken, ensures safety of the underwater tunnel by the remaining wire ropes, and which does not require maintenance and replacement of the wire ropes for a long period of time.

To achieve the above objects, the underwater tunnel of this invention comprises a foundation body moored to the bottom of the water; a support frame erected on the foundation body; and a tunnel body formed integral with the support frame; wherein the tunnel body is formed in a two-layer construction which consists of an outer shell and an inner shell so that spaces formed inside the inner shell and between the outer and inner shells can be used for desired purposes, and the support frame is so formed that its vertical cross section is virtually a regular triangle and that a water tank is formed at the inside bottom of the support frame.

It is also characterized in that the tunnel body and/or the support frame are moored in place at the bottom of the water or afloat in the water by means of the underwater mooring apparatus.

In this invention, the tunnel body is formed at the top with a tower, whose upper part is projected above the water.

The underwater mooring apparatus of this invention for mooring an underwater tunnel comprises a tension cable means whose one end is secured to an anchor and the other end is attached with a rotatable pulley; and a plurality of connecting wire means wound around the pulley attached to the tension cable means, the both ends of the connecting wire means being fixed to the structure to be moored; wherein one of the connecting wire means is normally under tension connecting the structure to be moored and the tension cable means and the remaining connecting wire means are normally set in a loosened state so that when the first tensed connecting wire means is broken, the remaining loosened connecting wire means can take over to hold the structure in place.

The underwater mooring apparatus of this invention may also comprise a connecting wire means having one end thereof secured to an anchor; a pressurizing unit installed inside an underwater structure to be moored; and a wind-up/feed-out equipment installed inside the underwater structure to which the other end of the connecting wire means is secured after being passed through the pressurizing unit; wherein the pressurizing unit consists of a guide pipe which passes through the wall of the underwater structure and through which the connecting wire means is passed and a means to pressurize and supply viscous fluid into the guide pipe so that the water will not enter into the underwater structure through the guide pipe.

The pressurizing unit may be controlled to apply a specified pressure to the viscous fluid according to the water pressure information from a water pressure detecting means installed on the outside of the underwater structure to be moored.

DETAILED DESCRIPTION OF THE PREFERRED EMBODIMENT

Figure 1:
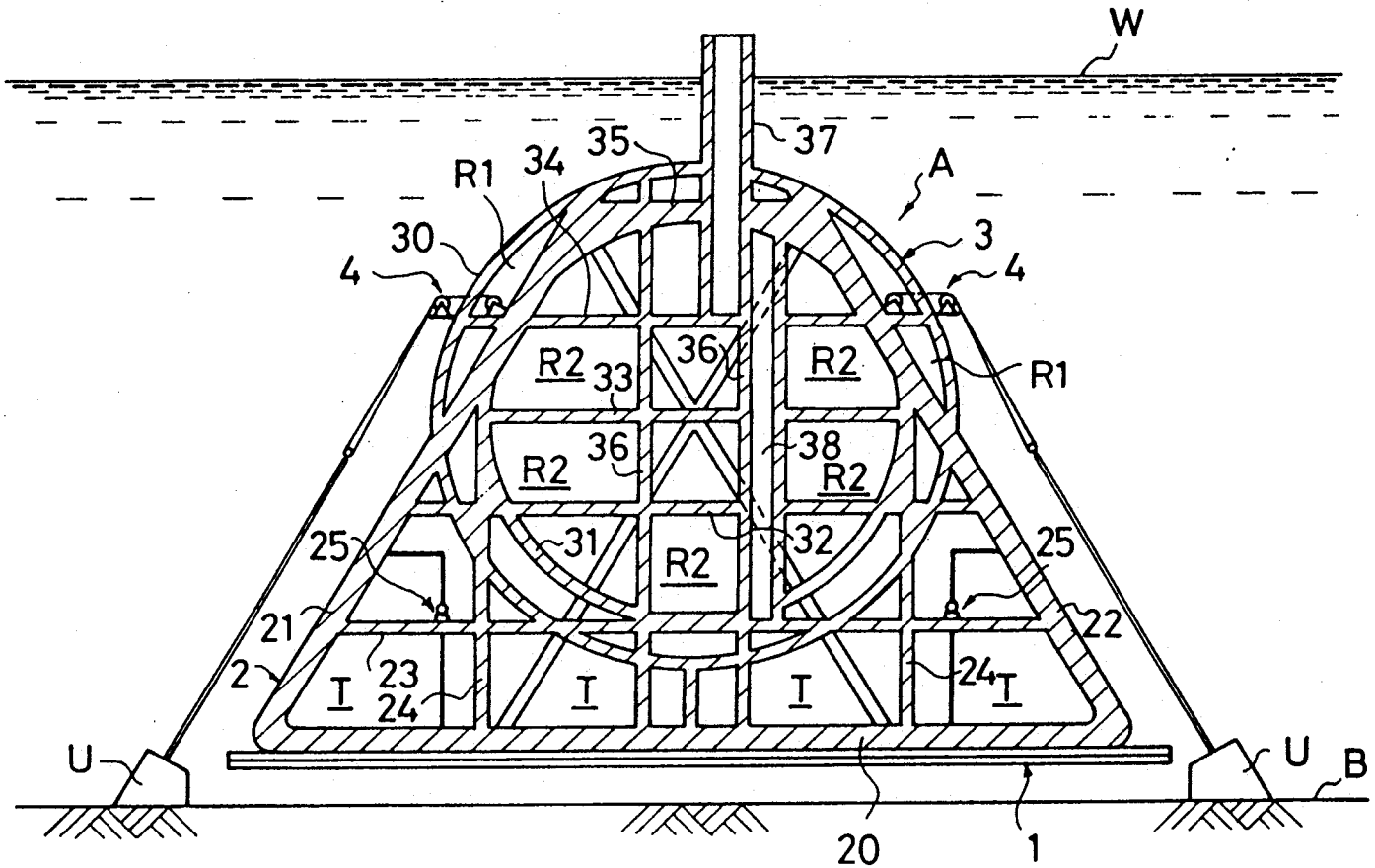
FIG. 1 is a vertical cross section showing the construction of the underwater tunnel as one embodiment of this invention.

As shown in FIG. 1, the underwater tunnel A of this embodiment consists of a foundation body 1 moored to the bottom of the water B, a support frame 2 erected on the foundation body 1, and a tunnel body 3 secured integrally to the support frame 2.

Figure 2:
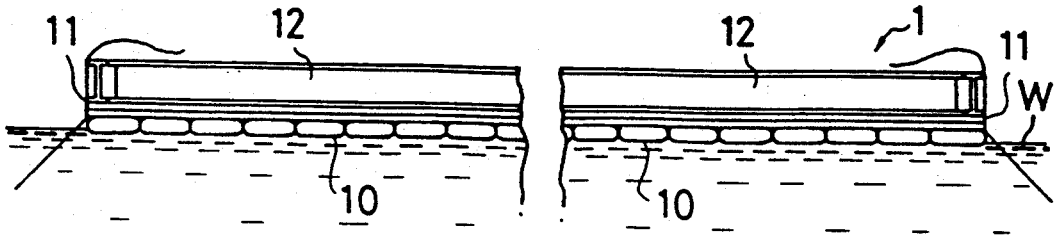
FIG. 2 is an enlarged cutaway front view of the foundation body on which the underwater tunnel is erected.
Figure 3:
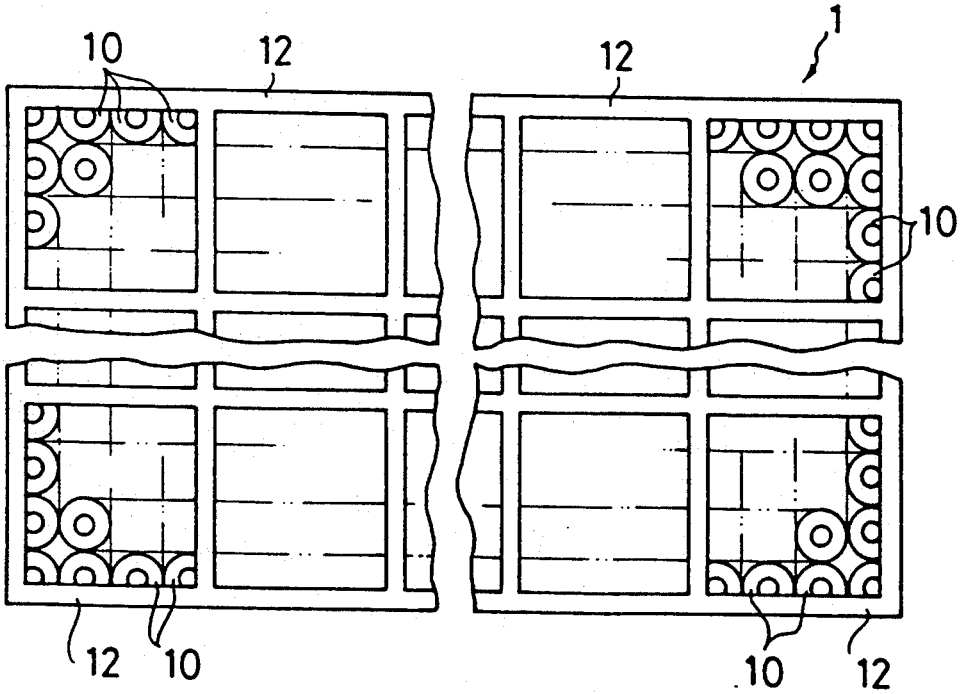
FIG. 3 is a partly cutaway, enlarged plan view of the foundation body.

The foundation body 1, before the support frame 2 is built on it, is designed to float on the water surface W. As shown in FIG. 2 and in FIG. 3, the foundation body 1 is made up of a number of float members 10 such as tire tubes, a binding frame 11 placed on the upper surface of the float members 10 to bind them together, and a support frame 12 formed integrally on the upper side of the binding frame 11. The large number of float members 10 generate a large buoyancy.

The float members 10 may be formed of polystyrene foam with a large buoyancy, instead of the tire tubes.

The foundation body 1 is constructed in a way that will offer as large a buoyancy as possible. The buoyancy of the foundation body 1 is so set that only the foundation body 1 can be floated on the water surface W and that the foundation body 1 will not sink to the bottom of the water when it is loaded on its upper surface with materials that are used to construct the tunnel body 1 or if the first-floor part of the tunnel body 2 is erected on it.

The foundation body 1 of such a construction is towed by a ship to the installation site of the underwater tunnel A or it is built at the site.

At the installation site, while afloat on the water surface W, the foundation body 1 is connected to anchors U fixed in the sea floor B to prevent it from being carried away by currents.

The support frame 2, as seen from FIG. 1, is formed into a cylinder whose vertical cross section is almost a regular triangle.

To describe in more detail, the support frame 2 consists of a horizontal bottom floor 20, a pair of inclined walls 21, 22 that rise at angles from both ends of the bottom floor 20 to merge at the apex, a first-story floor 20 arranged horizontally a certain distance above the bottom floor 20 to form a water tank T between it and the bottom floor 20, and vertical walls 24 rising from the bottom floor 20. By supplying water into the water tank T, the support frame 2, i.e., the tunnel A is sunk into water.

A pumping equipment 20 is installed on the first-story floor 20 to supply or discharge water to and from the water tank T.

The tunnel body 3 is integrally connected with the support frame 2 and has a two-layer construction consisting of the outer shell 30 and the inner shell 31 so that a space R1 formed between the outer and inner shells 30, 31 and a space R2 inside the inner shell 31 can be used for some purposes.

The spaces R1, R2 are partitioned by floors and walls as required to form a second-story floor 32, a third-story floor 33, a fourth-story floor 34, a top floor 35, vertical walls 36, a tower portion 37 as entrance and exit or for ventilation, and an elevator shaft 38.

Installed in the space R1 formed between the outer shell 30 and the inner shell 31 is a wind-up/feed-out means of the mooring apparatus 4 that is described later.

The underwater tunnel A of such a construction is built according to the procedure shown below.

Figure 4:
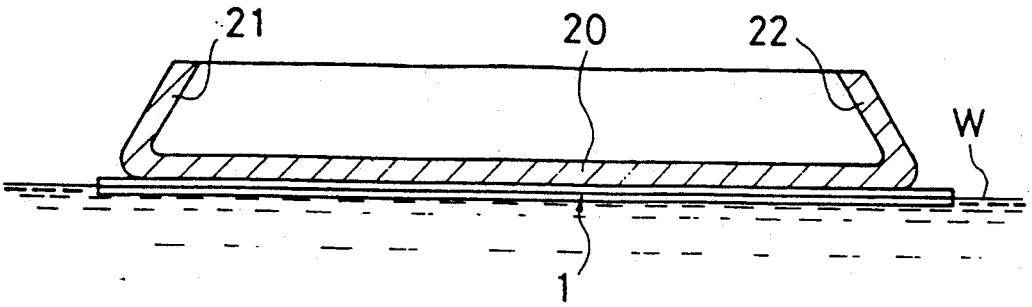
FIG. 4 is an enlarged vertical cross section showing the first process of building the support frame on the upper side of the foundation body.

First, as shown in FIG. 4, the bottom floor 20 is formed on the upper surface of the foundation body 1, followed by the inclined walls 21, 22 being erected at both ends of the bottom floor 20 only for one story. As a result, a space U-shaped in vertical cross section is formed on the upper side of the foundation body 1, thus permitting the following construction work to be carried out without being affected by winds and waves.

Figure 5:
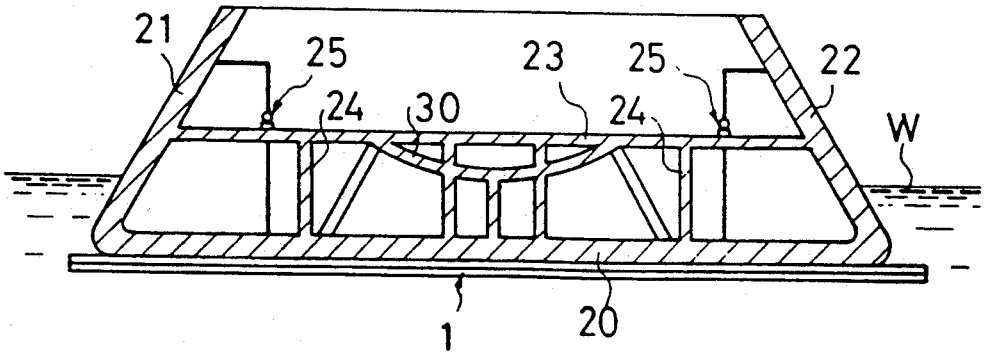
FIG. 5 is an enlarged vertical cross section showing the second process of building the support frame and a part of the tunnel body on the upper side of the foundation body.

After the inclined walls 21, 22 are formed, the first-story floor 20 and the vertical walls 24 as well as a part of the outer shell 30 are built inside the inclined walls. The inclined walls 21, 22 are extended for another story, after which the pumping equipment 25 and associated piping are installed on the first-story floor 23, as shown in FIG. 5.

Figure 6:
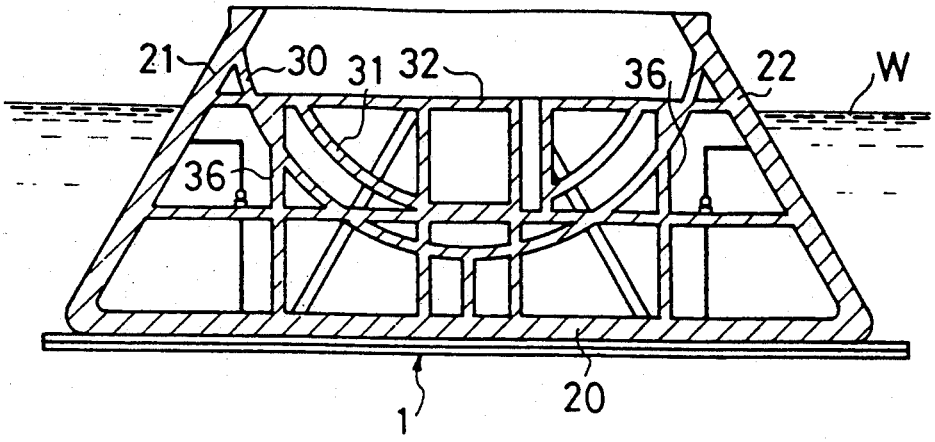
FIG. 6 is an enlarged vertical cross section showing the third process of building the support frame and the tunnel body on the upper side of the foundation body.

Next, as shown in FIG. 6, inside the extended inclined walls 21, 22 are built a partial extension of the outer shell 30 and a part of the inner shell 31. At the same time, the second-story floor 32 and the vertical walls 36 are formed. The inclined walls 21, 22 are further extended for one story.

Figure 7:
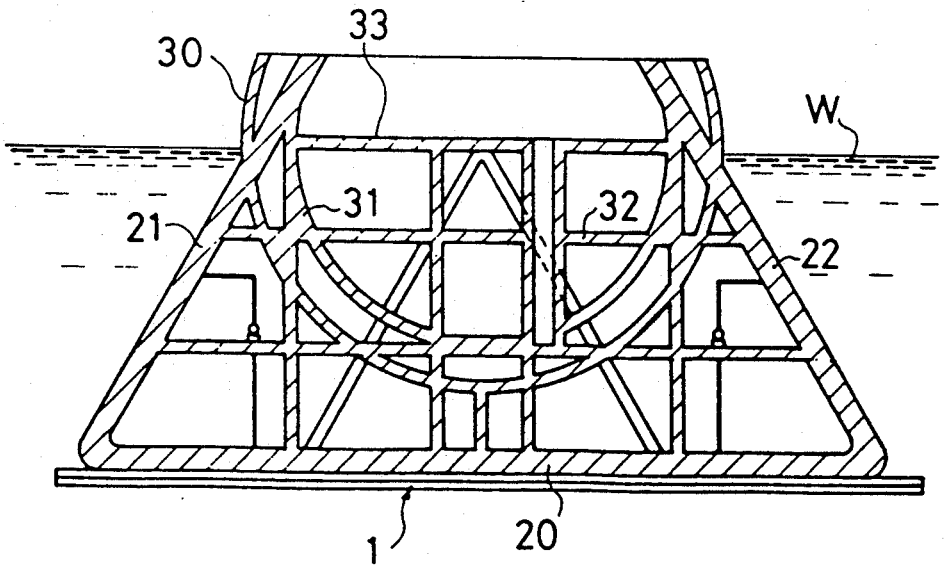
FIG. 7 is an enlarged vertical cross section showing the fourth process of building the support frame and the tunnel body on the upper side of the foundation body.
Figure 8:
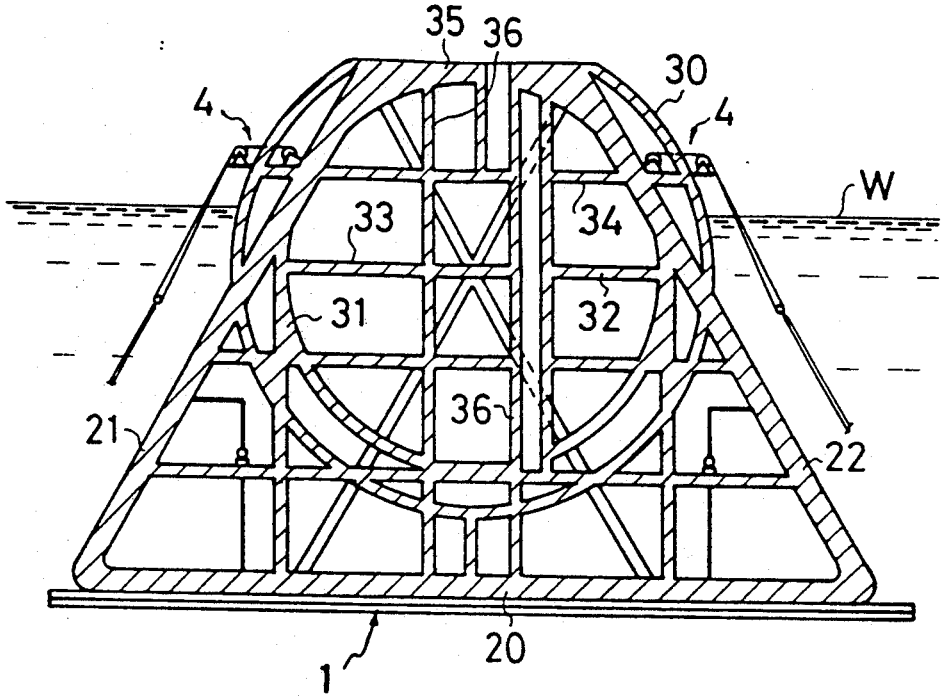
FIG. 8 is an enlarged vertical cross section showing the fifth process of building the support frame and the tunnel body on the upper side of the foundation body.

Then, as shown in FIG. 7 and 8, the outer and inner shells 30, 31 and the inclined walls 21, 22 are extended while at the same time the third-story floor 33, the fourth-story floor 34, the top floor 35 and the vertical walls 36 are built successively. In the last step, at the highest part of the tunnel body 3 the outer shell 30 is closed and formed with the tower portion 37.

At the extension of the fourth-story floor 34 between the outer shell 30 and the inner shell 31, there are installed wind-up/feed-out equipment of the mooring apparatus 4. The elevator shaft 38 is completed while the inner shell 31 is built.

The support frame 2 and the outer and inner shells 30, 31 that form the tunnel body 3 are constructed of reinforced concrete or steel-framed reinforced concrete with excellent water-resisting quality and pressure with-standability. They are so built as to ensure water-tightness of the underwater tunnel A.

In this specification, the pressure exerted on the underwater tunnel A represents the static water pressure or current-induced pressure acting on the entire surface of the outer wall of the submerged portion of the tunnel A under the water surface W. The pressure exerted on the tower portion 37 is the wind and wave pressure acting on the entire surface of the tower portion above the water surface W.

Figure 9:
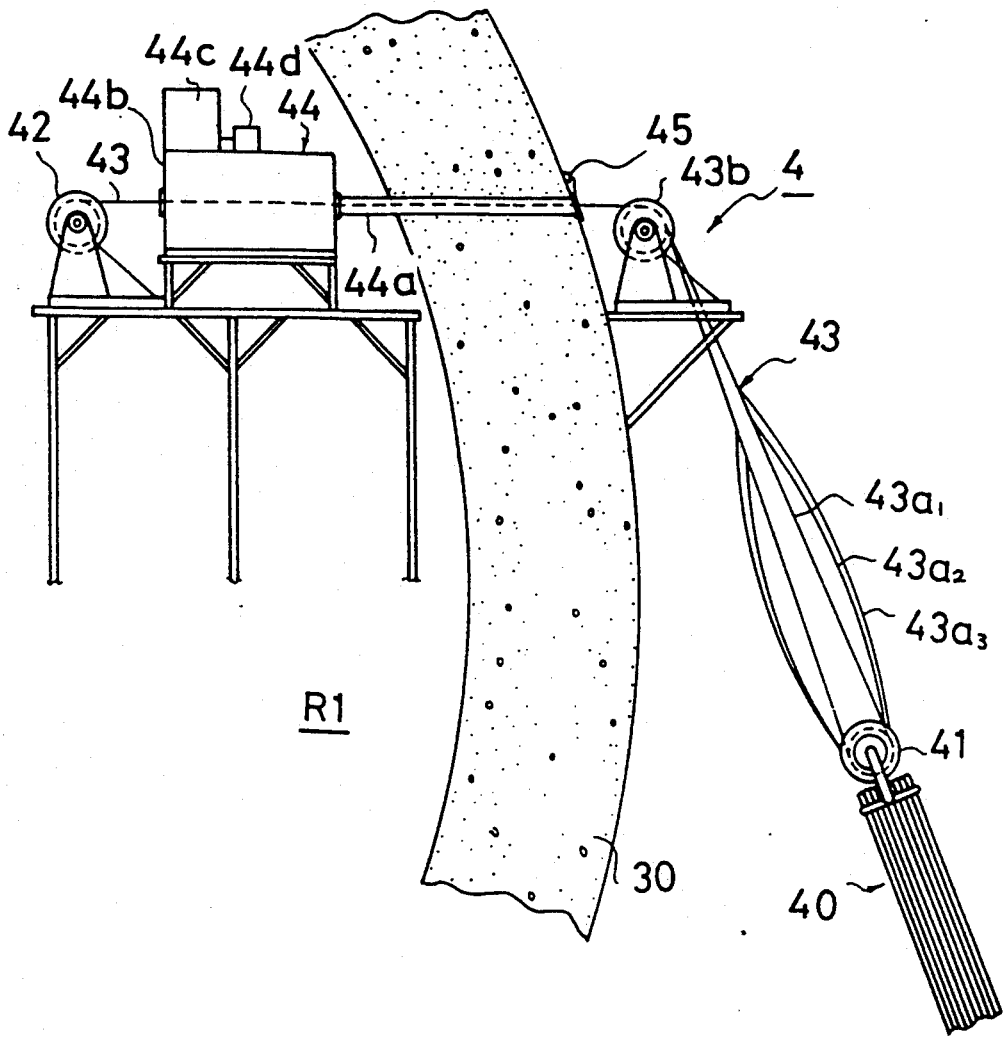
FIG. 9 is a cross section showing one embodiment of the mooring apparatus.
Figure 10:
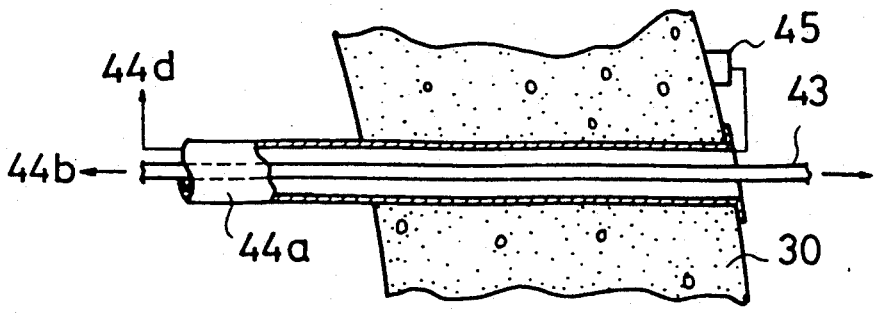
FIG. 10 is an enlarged cross section showing an essential part of the underwater mooring apparatus.

The underwater mooring apparatus 4 for mooring the underwater tunnel A of the above construction, as shown in FIG. 9 and 10, consists of: a tension cable means 40 with its lower end secured to the anchor U; a connecting wire means 43 which is connected at one end through a pulley 31 to the tension cable means 40 and at the other end is wound around a drum 42; and a pressurizing unit 44 to keep water-proof the portion of the underwater tunnel A where the connecting wire means 43 passes.

Figure 11:
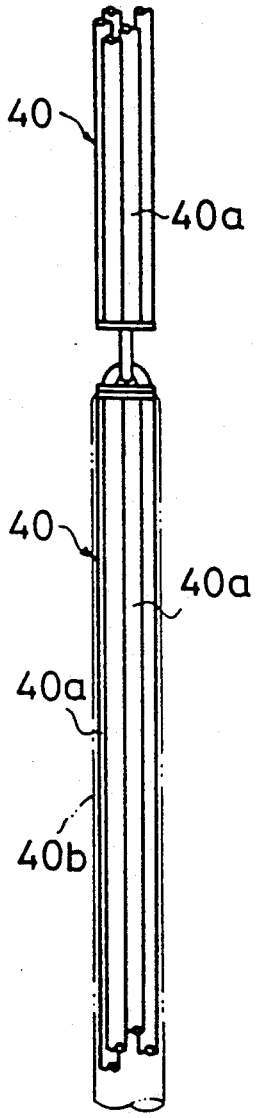
FIG. 11 is a partial front view of the tension cable means of the underwater mooring apparatus.

The tension cable means 40 has a specified tensile strength and, to reduce its weight as much as possible, consists of a plurality of hermetically enclosed pipes 40*a* and a large-diameter container pipe 40*b* accommodating the hermetically enclosed pipes 40*a* as shown in FIG. 11.

The hermetically enclosed pipes 40*a* and the large-diameter container pipe 40*b* are made of elastic material. The hermetically enclosed pipes 40*a* are filled with a high tensile material and a high tensile bonding agent, while the container pipe 40*b* is loaded with a high tensile bonding agent to make the hermetically enclosed pipes 40*a* bound as one solid member.

The connecting wire means 43 connects under tension the underwater tunnel A with the tension cable means 40. The both ends of the connecting wire means 43 are connected to the drum 42 that winds up or feeds out the connecting wire means 43. The intermediate portion of the connecting wire means 43 is wound around the pulley 41 held by the tension cable means 40.

The drum 42 is installed in a space R1 formed by an outer shell 30 and an inner shell 31 of the underwater tunnel A.

The connecting wire means 43 is made up of a plurality of wires, one of which $43a_1$ is normally under tension connecting the underwater tunnel A and the tension cable means 40. The remaining two wires $43a_2$, $43a_3$ are normally in a loosened condition serving as a backup and, in the event of failure of the first wire $43a_1$, take over to keep the underwater tunnel A in place. One of the two backup wires $43a_3$ is more loosened than the other backup wire $43a_2$ so that when the latter should fail, the former can take over and hold the underwater tunnel A in position.

Reference numeral 43*b* represents a pulley to change the travel direction of the connecting wire means 43. The pulley 43*b* is located between the pulley 41 and the drum 42 and outside the outer shell 30.

The pressurizing unit 44 is intended to keep water-tight the area of the tunnel through which the connecting wire means 43 is introduced from outside the outer shell 30 into the inside.

The pressurizing unit 44 consists of: a guide pipe 44*a* passing through the outer shell 30 and through which the connecting wire means 43 is passed; a water-proofing bath 44*b* containing viscous fluid such as grease; a reservoir 44*c* of the viscous fluid; a pressurizing pump 44*d* to supply and discharge the viscous fluid; and a water pressure sensor 45 attached to the outer wall of the outer shell 30. The pressurizing pump 44*d* is controlled to pressurize the viscous fluid according to the information from the water pressure sensor 45 so that the pressure of the viscous fluid is equal to or slightly greater than the water pressure.

When the depth of water where the underwater tunnel A is held is changed according to the specific gravity of the tunnel, the water pressure sensor 45 automatically measures the changed depth of water. A known pressure sensor with excellent water-tightness may be used for this purpose.

Since the interior of the guide pipe 44*a* is filled with viscous fluid from the water-proofing bath 44*b* which is pressurized to a pressure almost equal to the water pressure and the connecting wire means 43 is immersed in the viscous fluid, the water outside the outer shell 30 will not enter into the inside. As a result, the space R1 formed between the outer and inner shells 30, 31 can be effectively utilized. The viscous fluid pressure control on the pressurizing pump 44*d* can also be made manually.

With the underwater mooring apparatus 4 of this embodiment, when the underwater tunnel A is disconnected from the tension cable means 40 as by a break of the connecting wire means $43a_1$, the remaining connecting wire means $43a_2$, $43a_3$ will take over and safely keep the underwater tunnel in place.

The underwater mooring apparatus of this invention is not limited to the mooring of the underwater tunnel A but may also be applied to other structures, such as underwater buildings and floating breakwaters.

The underwater tunnel A of this embodiment has the water tank T formed at the inside bottom of the support frame 2 and the spaces R1, R2 formed between the outer and inner shells 30, 31 and inside the inner shell 31. One of the spaces R1 may be used for accommodating gas and tap water piping and telephone lines while the other space R2 may be used for footway, automobile road, railway track and for warehouse and garage. When a large-scale space is formed spanning several stories, it is possible to install an elevator or lift there.

Since the underwater tunnel of this embodiment can supply or discharge water into or out of the water tank T by the pumping equipment 25, it is possible to change the tunnel's depth of water thereby safely stabilizing the tunnel A under water. During stormy weather conditions, the upper end of the tower portion 37 may be closed and the underwater tunnel A be totally immersed in the water to effectively protect itself form effects of storm. Moreover, the underwater tunnel A, if held afloat from the sea floor B, is not easily affected by earthquakes.

In normal conditions, it is possible to set the water pressure acting on the tunnel A under the water surface W larger than the pressure acting on the entrance tower portion 27 to keep the underwater tunnel A in a stable condition at all times.

With this invention, it is possible to build an underwater tunnel in a short period and in the same process as employed in constructing buildings on land by means of a novel construction method which is totally different from conventional methods requiring the foundation work. This invention requires only the construction materials to be transported to the installation site rater than towing the large tunnel body by a ship. This reduces the construction cost significantly. Further, this invention permits the construction work to be performed on the water without being affected by water or waves, making this kind of work simple and safe.

Another advantage of this invention is that since the water pressure acting on the submerged portion of the tunnel body is set larger than the pressure acting on the entrance tower portion that projects above water, the tunnel remains stable. Furthermore, the interior of the underwater tunnel can be used for a variety of purposes.

Further, the underwater tunnel of this invention has a two-layer structure consisting of an outer shell and an inner shell, so that the outer shell does not require a stringent water-proofing measures. That is, infiltration of water into the interior of the inner shell can be effectively prevented by a small water pumping and air conditioning facilities, substantially reducing the construction cost. There is not need to tow a prefabricated structure to the construction site and that the component materials can be assembled at the site, which results in a substantial reduction in cost.

Furthermore, since the tunnel body is secured to the support frame whose vertical cross section is a regular triangle and which has a water tank at the bottom of its interior, it is possible to provide the tunnel with a sufficient strength against water pressure and to change the specific gravity of the underwater tunnel by supplying or discharging the water to and from the water tank to adjust the tunnel's depth of water. This adjustment of specific gravity may also be made by other means such as by pulling or feeding out the wire ropes secured to weights or anchors.

In this mooring apparatus that holds in place a large-scale structure such as an underwater tunnel at a specified depth of water, if one end of the connecting wire means is secured to the wind-up/feed-out equipment installed inside the underwater structure, this invention prevents the water from entering through a part of the underwater structure where the connecting wire means passes. If the underwater tunnel is disconnected from the tension cable means as by a break of the connecting wire means, the remaining connecting wire means will take over and safety keep the underwater tunnel in place. Moreover, the mooring apparatus does not require maintenance and inspection or replacement of the wire ropes for a long period of time, simplifying the maintenance work and significantly reducing the maintenance cost.

What is claimed is:

1. An underwater tunnel, comprising:

a foundation body moored to the bottom of the water;

a support frame erected on the foundation body; and a tunnel body formed integral with the support frame, wherein the tunnel body is formed in a two-layer construction circular in cross section which consists of an outer shell and an inner shell so that spaces formed inside the inner shell and between the outer and inner shells can be used for predetermined purposes, wherein the support frame is formed to have a triangular vertical cross section, said support frame including a water tank formed at the inside bottom of the support frame and a pumping means located external to said water tank for pumping water into and out of said water tank, and wherein the tunnel body and/or the support frame are moored afloat from the bottom of the water by means of an underwater mooring apparatus.

2. An underwater tunnel as claimed in claim 1, wherein the upper part of the tunnel body is formed with a tower whose upper portion is projected from water.

3. An underwater tunnel as claimed in claim 1 or claim 2, further comprising:

a tension cable means whose one end is secured to an anchor and the other end is attached with a rotatable pulley; and a plurality of connecting wire means wound around the pulley attached to the tension cable means, the both ends of the connecting wire means being fixed to the structure to be moored;

wherein one of the connecting wire means is normally under tension connecting the structure to be moored and the tension cable means and the remaining connecting wire means are normally set in a loosened state so that when the first tensed connecting wire means is broken, the remaining loosened connecting wire means can take over to hold the structure in place.

4. An underwater tunnel as claimed in claim 3, further comprising:

a connecting wire means having one end thereof secured to an anchor;

a pressurizing unit installed inside an underwater structure to be moored; and a wind-up/feed-out equipment installed inside the underwater structure to which the other end of the connecting wire means is secured after being passed through the pressurizing unit;

wherein the pressurizing unit consists of a guide pipe which passes through the wall of the underwater structure and through which the connecting wire means is passed and a means to pressurize and supply viscous fluid into the guide pipe so that the water will not enter into the underwater structure through the guide pipe.

5. An underwater tunnel as claimed in claim 4, wherein the pressurizing unit is controlled to apply a specified pressure to the viscous fluid according to the water pressure information from a water pressure detecting means installed on the outside of the underwater structure to be moored.

* * * * *